US010501158B1

(12) United States Patent
DeBoer

(10) Patent No.: US 10,501,158 B1
(45) Date of Patent: Dec. 10, 2019

(54) SWIFT WATER RESCUE SLED AND METHOD

(71) Applicant: Dane J DeBoer, San Clemente, CA (US)

(72) Inventor: Dane J DeBoer, San Clemente, CA (US)

( * ) Notice: Subject to any disclaimer, the term of this patent is extended or adjusted under 35 U.S.C. 154(b) by 0 days.

(21) Appl. No.: 16/109,557

(22) Filed: Aug. 22, 2018

(51) Int. Cl.
*B63C 9/26* (2006.01)
*B63C 9/04* (2006.01)

(52) U.S. Cl.
CPC . *B63C 9/26* (2013.01); *B63C 9/04* (2013.01)

(58) Field of Classification Search
CPC ..... B63C 9/26; B63C 9/04; B63C 9/00
USPC ..... 441/35, 50, 80, 84, 129, 136
See application file for complete search history.

(56) References Cited

U.S. PATENT DOCUMENTS 3,887,953 A * 6/1975 Eisenhauer ..... B63C 9/04 441/37
4,968,046 A * 11/1990 O'Connell ..... B62B 15/00 114/43
5,354,222 A * 10/1994 Elias ..... B63B 21/56 114/249
5,421,757 A * 6/1995 Basiliere ..... B63C 9/04 441/128
6,641,446 B1 * 11/2003 Bentley ..... B62B 13/06 280/19
7,810,820 B2 * 10/2010 Wolf ..... A61G 1/01 280/18
8,496,507 B2 * 7/2013 Poston ..... B63C 9/04 441/80
9,487,226 B2 * 11/2016 Coates ..... B62B 17/061
2002/0119715 A1 * 8/2002 Pons ..... B63C 9/00 441/80

* cited by examiner

*Primary Examiner* — Anthony D Wiest
(74) *Attorney, Agent, or Firm* — Morland C. Fischer

(57) ABSTRACT

A swift water rescue sled and a method for rescuing an individual who has fallen into swift moving water. A stationary steering line is attached to the bottom of the rescue sled between the opposite sides thereof. An anchor line runs in a first direction along the top of the sled and then in an opposite direction along the bottom at which the anchor line bends around an anchor line pulley. From the anchor line pulley, the anchor line turns around and runs in the first direction along the bottom of the sled and outwardly from the front to be tied to an anchor. A steering line pulley rides over the stationary steering line. The anchor line and steering line pulleys are coupled to one another at the bottom of the rescue sled. The rescue sled is steered towards the individual in response to the operator shifting his weight.

18 Claims, 8 Drawing Sheets

SWIFT WATER RESCUE SLED AND METHOD

BACKGROUND OF THE INVENTION

1. Field of the Invention

This invention relates to a lightweight, easy to transport swift water rescue sled that has particular application for rescuing an individual who has fallen into and is being pulled downstream by swift moving water. The rescue sled includes anchor and steering lines (e.g., multi-strand ropes) that are coupled to one another underneath the sled at approximately midway along its length to permit the sled to be accurately steered towards an individual to be rescued in response to the sled operator shifting his weight from side-to-side.

2. Background Art

Individuals are known to accidentally fall into swiftly moving water such as that found in a river, aqueduct, spillway flood control channel, or the like. A common rescue attempt involves throwing a rope or a floatation device to the individual hoping to be rescued. However, because the individual is often moving rapidly in the water, he may miss catching the rope or floatation device entirely. This leaves the rescuers having to catch up to the individual if they wish to try another rescue attempt. Moreover, such a rescue attempt requires that the individual to be rescued, who is often exhausted and perhaps injured, have the strength and ability to grab and hold onto the device that is thrown to him.

Helicopters have also been used to fly overhead and dangle a rope above the individual. Once again, the individual must be able to catch and hold onto the rope. What is more, the use of a helicopter to affect a rescue can be expensive, and a helicopter is not always readily available to come to the aid of the individual in the short time within which to complete the rescue.

Inflatable boats are known to be dropped in the water to try and catch the individual rushing towards it. An anchor line is typically tied between land and the front (e.g., nose) of the boat. Because the swiftly moving water usually moves with great force against the front of the boat to which the anchor line is tied, it is sometimes difficult to accurately steer and maneuver the boat against the power of the water to get close enough to the individual so that he can be grabbed and pulled aboard. Missing the oncoming individual may not leave enough time or opportunity to redeploy the boat to make another rescue attempt.

Therefore, what would be desirable is a relatively low cost, simple to deploy and easy to transport rescue sled that can be accurately steered and maneuvered towards an individual being pulled by swiftly moving and powerful water without requiring that the individual participate in his own rescue by having to grab, hold onto or pull a rescue device.

SUMMARY OF THE INVENTION

In general terms, disclosed herein is a swift water rescue sled and a method for steering the sled to rescue an individual who has fallen into and is being pulled downstream by swift moving water. By virtue of the rescue sled herein disclosed, the rescue may be accomplished without the requirement that the individual actively participate in the process by having to grab, hold onto or pull a rescue device.

The rescue sled has a compact size and light weight to be easily transported in the back of a pickup truck or the like.

The rescue sled includes a buoyant body that is manufactured, for example, from closed cell high density foam so as to be capable of floating in water. A supply of anchor line (e.g., high strength multi-strand rope) is dispensed from a conventional fishing reel that is bolted to the top of the sled. The anchor line runs continuously, first in a forward direction along the top of the sled, then around a line guide affixed to the nose of the sled where it turns back and extends rearwardly along the bottom of the sled to an anchor line pulley, at which point the anchor line turns around and once again runs in a forward direction along the bottom. The free end of the anchor line extends past the nose to be tied to an anchor that is implanted in the ground adjacent the water in which the rescue line will be deployed.

A stationary steering line runs laterally across the bottom of the rescue sled at approximately midway along its length. A steering line pulley that is shackled to the anchor line pulley underneath the sled is positioned to ride over the steering line. In order to accurately steer the rescue sled towards an oncoming individual being carried downstream by the rushing water, the sled operator simply shifts his weight to one side or the other. The steering line pulley will correspondingly ride from side-to-side along the steering line depending upon the direction in which the operator shifts his weight. The anchor line pulley and the anchor line that is tied to the land-based anchor move with the steering line pulley relative to the stationary steering line to enable the rescue sled to be maneuvered alongside the individual seeking rescue. The anchor line is controllably let out from the fishing reel until the individual and the rescue sled are traveling in the water at the same speed. Accordingly, the speed and power of the water will now be neutralized to enable the operator of the rescue sled to come alongside and pull the individual onboard and thereby complete the rescue.

DESCRIPTION OF THE PREFERRED EMBODIMENT

Figure 1:
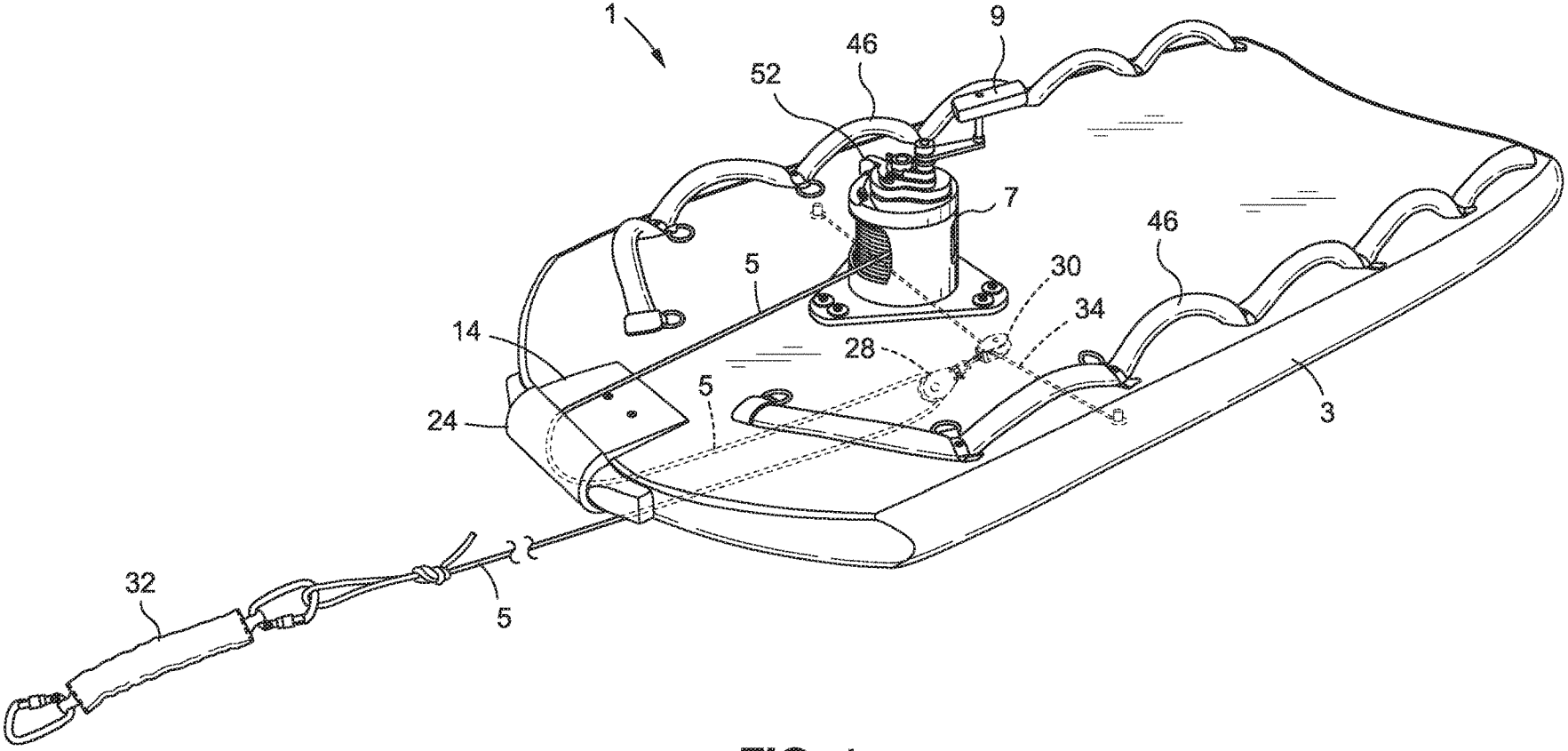
FIG. 1 is a perspective view showing a preferred embodiment for a rescue sled to be used in making swift water rescues according to the present invention.

Referring initially to FIGS. 1-7 of the drawings, there is shown a rescue sled 1 that has particular application for rescuing individuals who have fallen into and are being pulled downstream by swift moving water and/or waves common to a river, aqueduct, spillway and flood control channel. However, the rescue sled 1 of this invention is also capable of rescuing individuals and animals trapped in ice. The rescue sled 1 is lightweight and has a compact size so as to be easily transported to the rescue site in the back of a pickup truck or the like. In this regard, to be able to achieve accurate steering, the rescue sled is sized to accommodate the upper half of the operator's body, while his legs dangle in the water.

The rescue sled 1 has a flat body 3 that is adapted to float in water or slide over ice. An initially rolled up supply of high strength rope or line 5 is carried by the rescue sled 1 to be dispensed during a rescue and attached to an anchor that is implanted in the ground adjacent the waterway. By way of example, the anchor line 5 is ideally a 12 strand, 3/16 inch thick polyethylene fiber rope. By way of further example, the supply of anchor line 5 can be rolled up on a conventional fishing reel such as that manufactured by Accurate Grinding & Manufacturing Corporation of Corona, Calif. The fishing reel 7 is affixed (e.g., bolted) to the top of the body 3 of sled 1. The fishing reel 7 has a usual handle 9 to which a rotational force is manually applied at those times when the rolled up line 5 that has been dispensed must be rewound and rolled back up.

Figure 2:
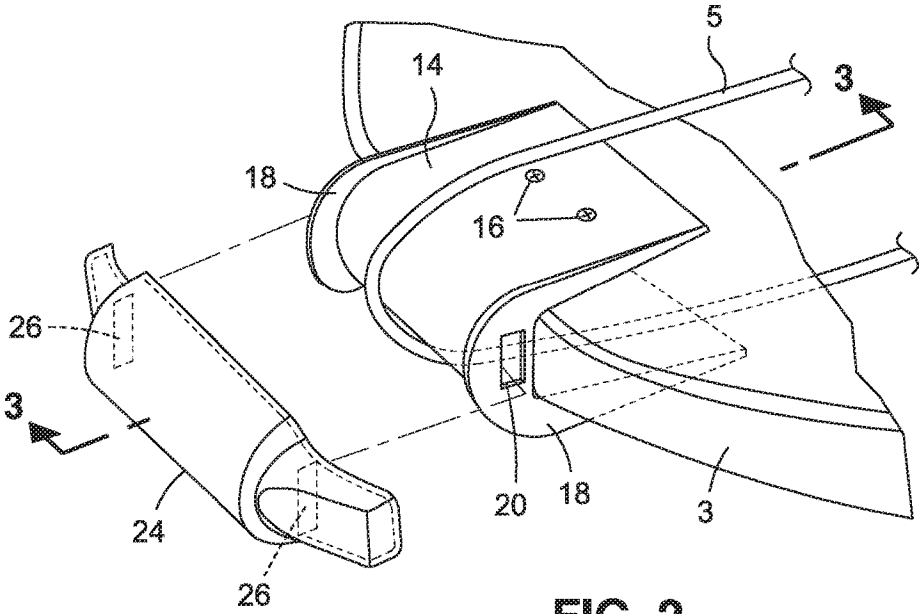
FIG. 2 is an exploded view showing the nose at the front of the rescue sled of FIG. 1.
Figure 3:
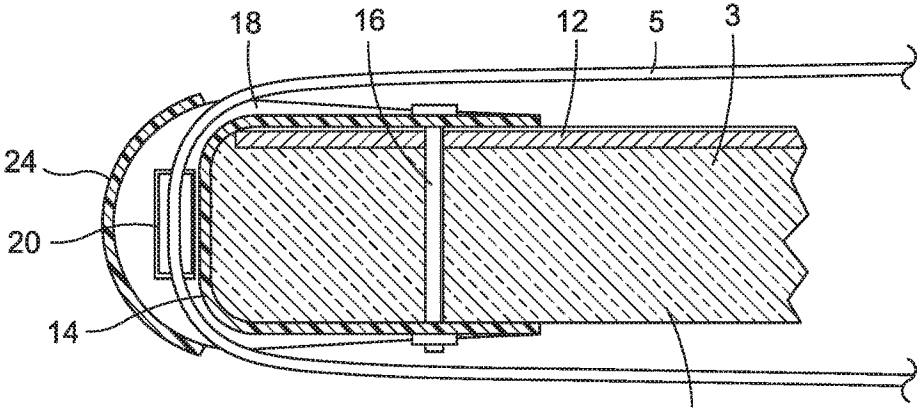
FIG. 3 is a cross-section taken along lines 3-3 of FIG. 2.
Figure 4:
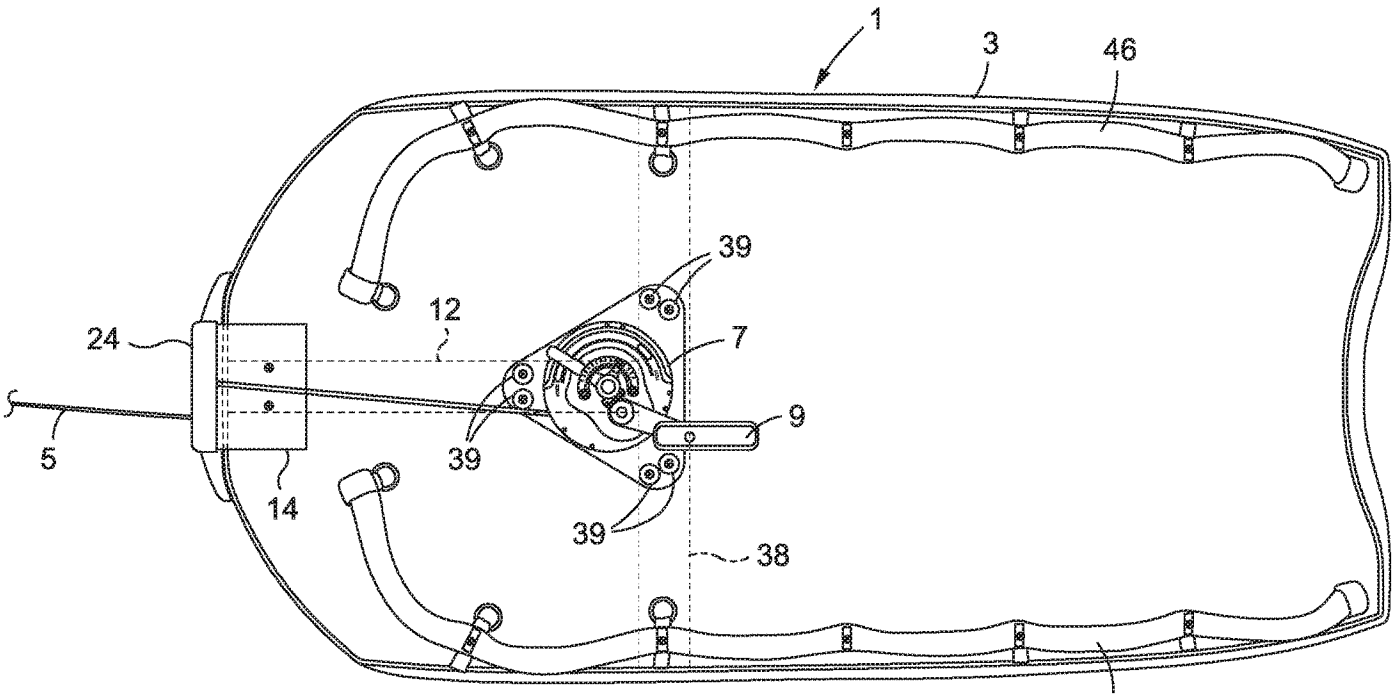
FIG. 4 is a top plan view of the rescue sled shown in FIG. 1.
Figure 5:
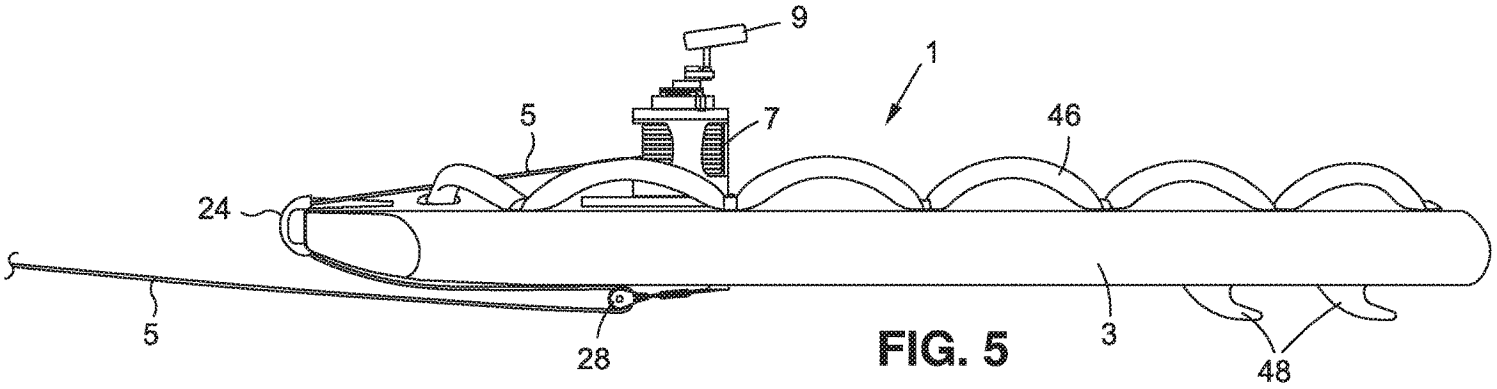
FIG. 5 is a side elevational view of the rescue sled shown in FIG. 1.

As is best shown in FIGS. 2 and 3, the buoyant body 3 of the rescue sled 1 is preferably manufactured from a closed cell high density foam such as that manufactured by High Surf Accessories of Maui, Hi. A longitudinally extending structurally reinforcing (e.g., fiberglass) mounting plate 12 runs along the top of the foam body 3 to establish a foundation at which the fishing reel 7 is affixed to the sled 1. The nose at the front of the sled 1 is surrounded by a generally C-shaped line guide 14 that covers the front of the sled body 3 and the mounting plate 12 that lies on the top of the sled body 3. The line guide 14 is held in place against the nose of sled 1 by means of a pair of mounting bolts 16 (best shown in FIGS. 2 and 3) that extend completely through line guide 14, the front of the mounting plate 12 that is covered by the line guide, and the sled body 3.

The anchor line 5 is dispensed from the rolled up supply thereof (i.e., fishing reel 7) so as to run over and around the C-shaped line guide 14. To this end, an upstanding line containment wall 18 (also best shown in FIGS. 2 and 3) is located at each of the opposite sides of the line guide 14 to prevent the line 5 from sliding off the guide as the line moves from side-to-side during a rescue. A coupling window 20 is formed through each line containment wall 18 of the line guide 14.

An end cap 24 is detachably connected over the line guide 14 at the nose of the rescue sled 1. The end cap 24 includes a pair of snap-on couplers (e.g., clips) 26 which are removably received by respective coupling windows 20 formed in the upstanding line containment walls 18 of the line guide 14 by which the end cap 24 is detachably connected over the line guide. The end cap 24 is preferably manufactured from an impact resistant material so as to function as a front bumper for the rescue sled 1 to push aside debris encountered in the waterway during the rescue.

As is best shown in FIG. 1, the rolled up supply of anchor line 5 being dispensed from the fishing reel 7 first extends in a forward direction towards the nose of the rescue sled 1 so as to run along the top of the sled body 3, over and around the line guide 14, and below the end cap (i.e., bumper) 24. The anchor line 5 then turns backs upon itself to run in an opposite rearward direction along the bottom of the sled body towards a pair of pulleys 28 and 30 that are coupled one to the other below the sled body 3.

Figure 8:
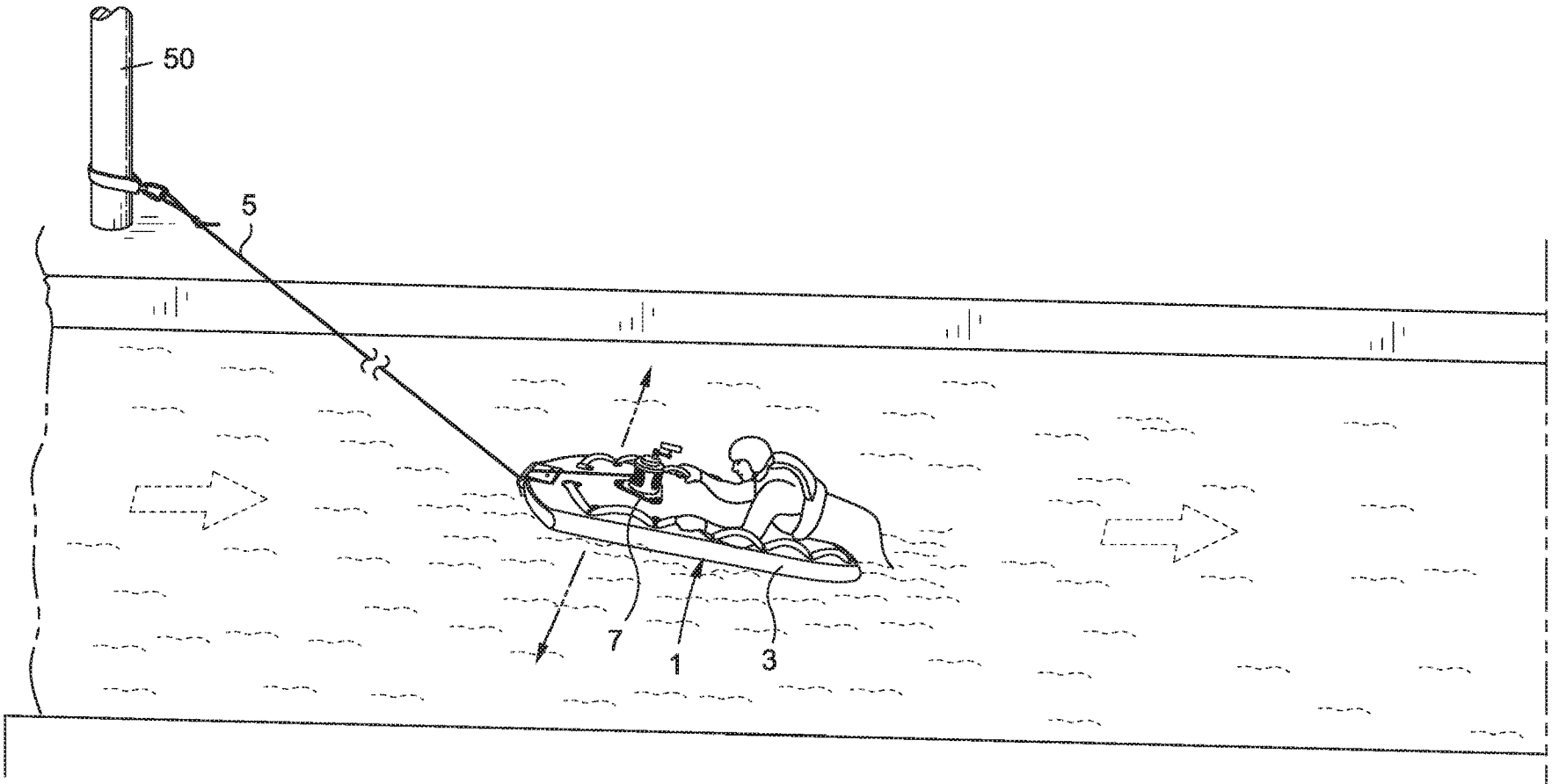
FIGS. 8-11 illustrate the steps of a method by which the rescue sled is maneuvered to rescue the floating individual moving downstream.

More particularly, and as an important feature of this invention, the anchor line 5 bends around an anchor line pulley 28 and reverses its direction to once again run in the forward direction towards the nose of the rescue sled 1. The anchor line 5 runs along the bottom of the sled body 3 (best shown in FIG. 5) in the forward direction until it extends outwardly therefrom ahead of the end cap 24 at the nose of the sled 1. The free end of the anchor line 5 is tied to one end of an optional resilient shock absorber 32. The opposite end of the shock absorber 32 is adapted to be coupled to a stationary anchor (designated 50 in FIG. 8) that is implanted in the ground alongside the waterway in which the rescue sled will be deployed to accomplish the rescue. The optional shock absorber 32 can be eliminated such that the free end of the anchor line 5 at the front of the sled 1 is tied directly to the anchor 50.

Figure 6:
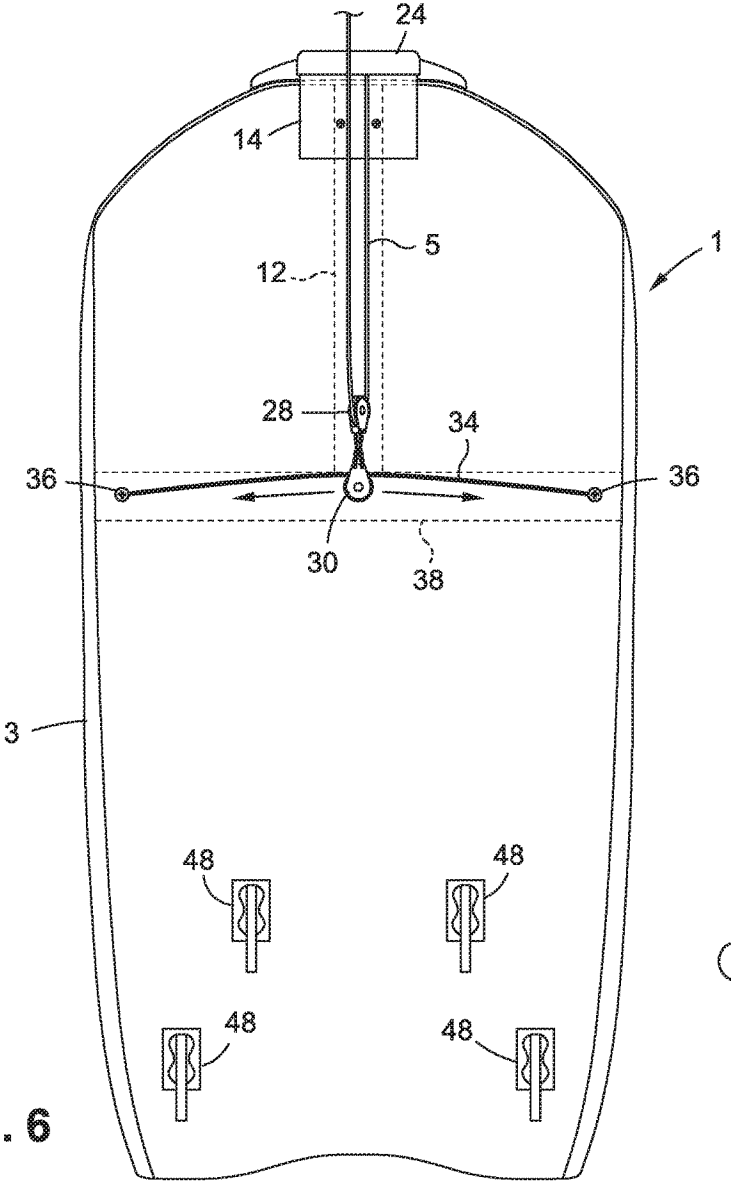
FIG. 6 is a bottom plan view of the rescue sled shown in FIG. 1.

A stationary steering line 34 runs laterally across the bottom of the body 3 of the rescue sled 1 at approximately midway along the length thereof. The steering and anchor lines 5 and 34 can be identical ropes as that described above. As is best shown in FIG. 6, the steering line 34 is anchored to the bottom of the rescue sled 1 at opposite sides of the body 3 by means of mounting bolts 36. Similar to the previously described longitudinally extending mounting plate 12, a laterally extending mounting plate 38 (best shown in FIGS. 4 and 6) is located atop the foam core 10 of the sled body 3. The mounting plate 38 runs from side-to-side and across the top of the sled body 3 to establish a structurally reinforcing foundation at which the steering line mounting bolts 36 are affixed to the sled 1. The laterally extending mounting plate 38 intersects the longitudinally extending mounting plate 12 to establish a 3-point mount within which to receive three pairs of supply line mounting bolts 39 by which to affix the fishing reel 7 to the top of the sled body 3.

The stationary steering line 34 runs over a steering line pulley 30 that is adapted to ride back and forth (i.e., from side-to-side) along the steering line and across the bottom of the body 3 of the rescue sled 1 as the operator of the sled shifts his weight from side-to-side. By virtue of the foregoing, the operator can maneuver the rescue sled 1 towards the individual in need of rescue by means of a single line steering system and by simply leaning to one side of the body 3 and shifting his weight.

Figure 7:
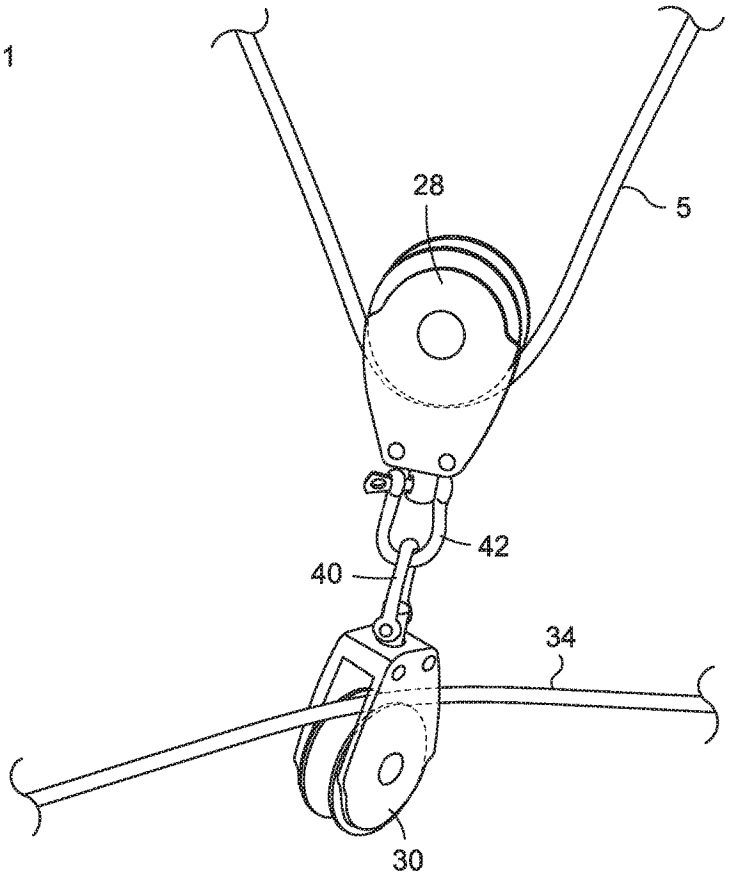
FIG. 7 shows anchor line and steering line pulleys shackled together at the bottom of the rescue sled to enable the sled to be steered towards an individual who is floating in swift moving water and in need of rescue.

FIG. 7 shows the anchor line pulley 28 and the steering line pulley 30 coupled to one another at the bottom of the rescue sled 1 behind the nose. Each pulley 28 and 30 has a C-shaped shackle 40 and 42 that are coupled together one inside the other so that the steering line pulley 30 is pulled towards the anchor line pulley 28 while riding on the steering line 34. Thus, as the sled operator shifts his weight to one side and then the other and the steering line pulley 30 correspondingly rides from side-to-side over the stationary steering line 34, the anchor line pulley 28 and the anchor line 5 extending therearound are pulled with one another by the steering line pulley 30 so that both the anchor line 5 and the anchor line pulley 28 move back and forth relative to steering line 34 across the bottom of the body 3 of the rescue sled 1.

A set of soft (e.g., rubber) grab handles 46 run along each side of the rescue sled 1 at the top of the body 3 to provide a continuous grip at which the sled can be carried to and from its transport vehicle to be deployed into and lifted out of the water. The grab handles 46 also provide the operator with support on which to hold while riding atop the sled 1.

As is best shown in FIG. 6, a set of steering fins 48 are affixed to and extend downwardly from the bottom of the sled body 3 to help the sled operator maneuver the sled in the direction of the individual waiting to be rescued.

Referring concurrently to FIGS. 8-12 of the drawings, details are provided of a preferred method for using the rescue sled 1 of FIGS. 1-7 to rescue an individual being pulled through swift moving water. Prior to the rescue sled 1 being deployed in the water, the free end of the anchor line 5 that extends past the nose of the sled is tied to or looped around the anchor 50 that is implanted in the ground adjacent the water way (best shown in FIG. 8). The anchor 50 can be any one of a post, stake, tree or the like. In cases of emergency, the free end of the anchor line 5 can be held by another member of the rescue team who is not riding in the sled 1.

Figure 9:
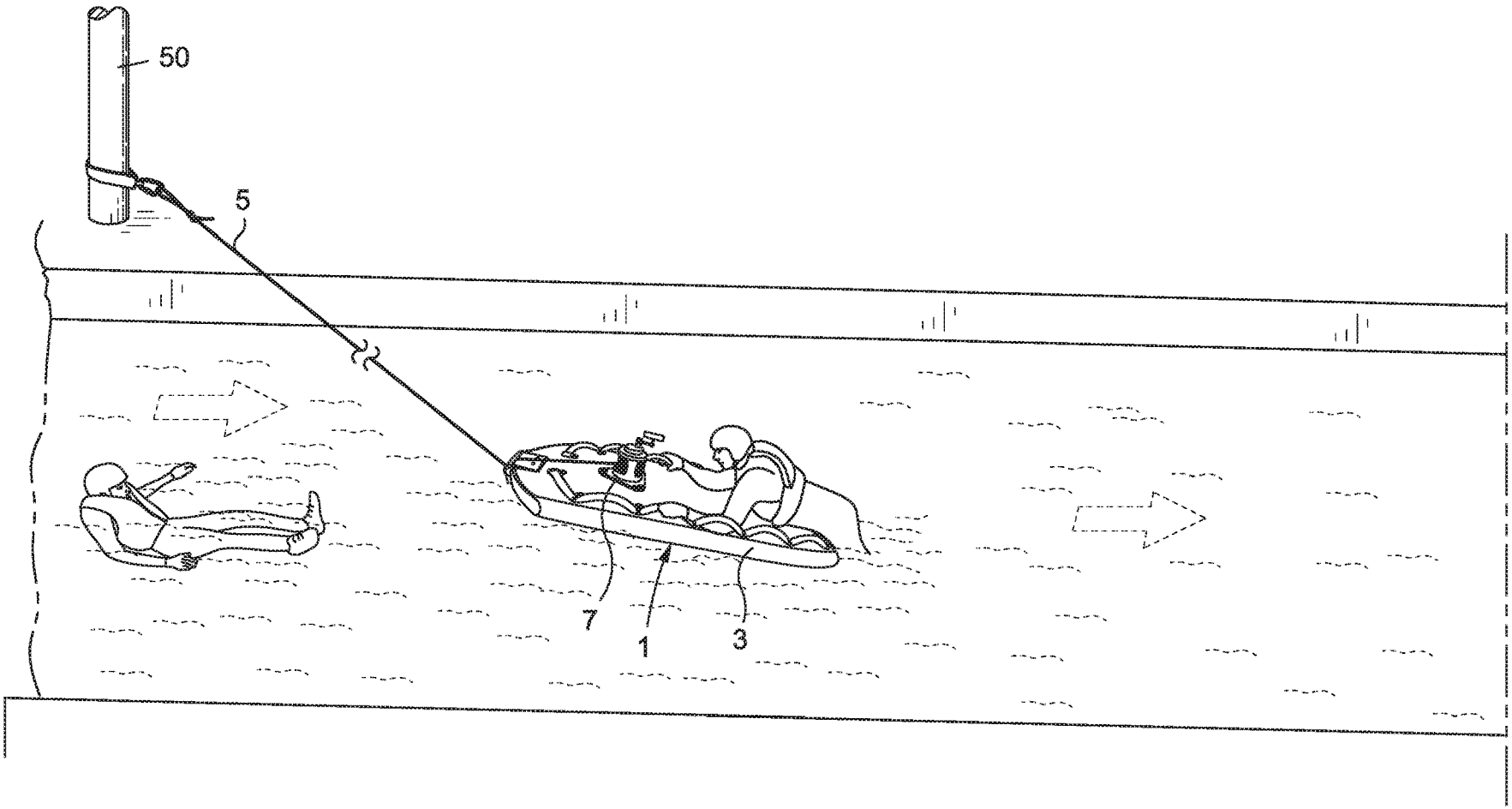
Figure 10:
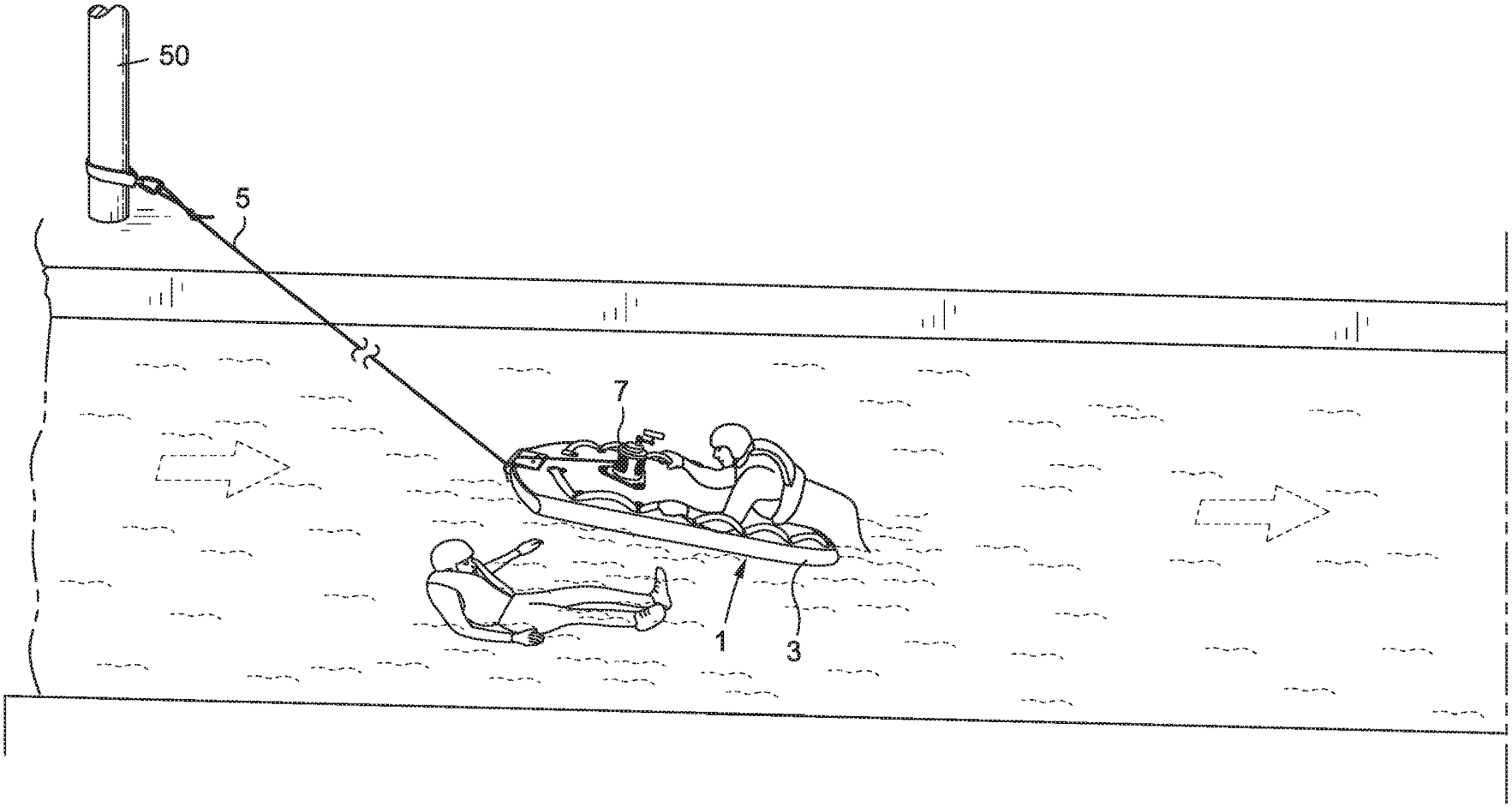

FIGS. 9 and 10 show the individual to be rescued moving in the water at a rapid speed towards the rescue sled 1. As previously explained, the rescue team member who operates the rescue sled 1 can simply shift his body weight from side-to-side to approach the individual in need of being rescued. That is, the steering line pulley 30 rides along the stationary steering line 34 to one side of the sled or the other depending upon the direction in which the operator shifts his weight. By virtue of the steering line pulley 30 being coupled to the anchor line pulley 28 at the bottom of the sled 1 and at a location approximately midway along its length (best shown in FIGS. 6 and 7), the water flows under the sled and not directly against the nose. Thus, the operator is able to reliably steer and maneuver the sled towards the individual despite the power and speed of the water.

Figures 11, 12:
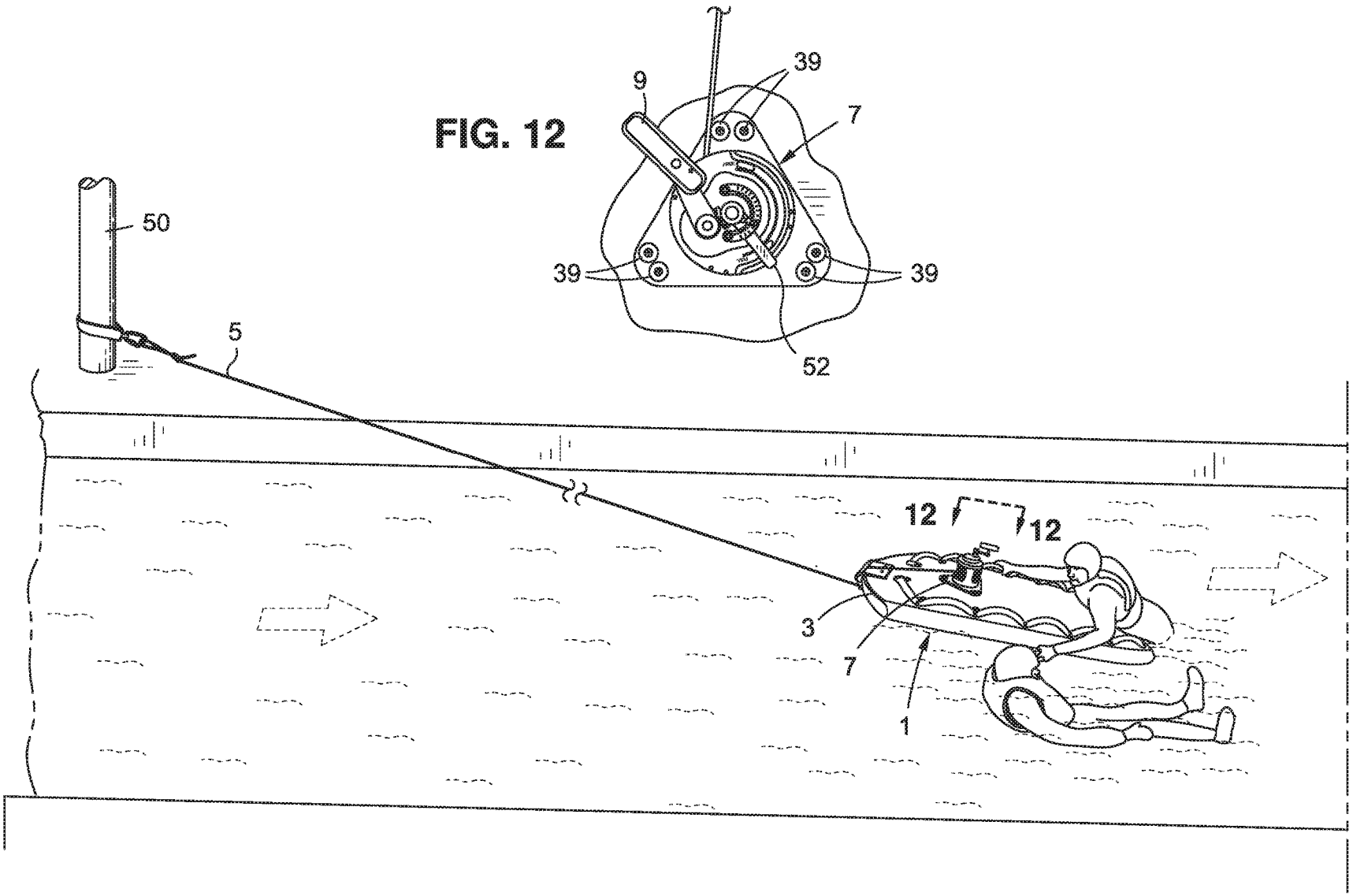
FIG. 12 is a top view of a fishing reel anchor line dispenser taken in the direction of lines 12-12 of FIG. 11.

As an important step of the rescue process, prior to making the rescue, the speed of the rescue sled 1 is adjustably controlled to match the speed of the approaching individual. Referring in this regard to FIGS. 11 and 12, the foregoing step is accomplished by operating the usual drag lever (designated 52 in FIG. 12) of the fishing reel 7 in order to dispense the rolled up anchor line 5. The anchor line 5 is controllably let out from the reel 7 until both the individual and the rescue sled 1 are floating side-by-side one another at the same speed.

Accordingly, the force and speed of the rapidly moving water are effectively neutralized. With the individual located alongside the rescue sled 1, the operator can grab hold of and pull the individual onboard the sled (best shown in FIG. 11). The rewind handle 9 of the fishing reel 7 can now be operated to retract the anchor line 5 and correspondingly pull the sled 1 towards the anchor 50 and the safety of the ground in which the anchor is implanted by which to conclude the rescue operation. It may be appreciated that the rescue is advantageously accomplished without requiring that the individual who may be injured or whose strength may be sapped, actively participate in the process by having to grab, hold onto or pull himself towards a rescue device as may otherwise be necessary in conventional rescue methods.

The invention claimed is:

1. A rescue sled to be deployed in water and maneuvered by an operator to rescue an individual floating in the water, said rescue sled including a body having a front end, a rear end, a top, a bottom and opposite sides, and comprising:

an anchor line having a first end attached to the body and an opposite free end extending outwardly from said body and adapted to be tied to an anchor located outside the water in which the rescue sled is to be deployed;

a stationary steering line running laterally across the bottom of the rescue sled between the opposite sides of said body located between the front end and rear end thereof; and a steering line pulley by which said anchor line is coupled to said stationary steering line so that the rescue sled is steered towards the individual in need of being rescued in response to the operator of said rescue sled shifting his weight towards one of the opposite sides of said body by which to cause said steering line pulley and said anchor line to correspondingly move relative to said stationary steering line towards the one of said sides.

2. The rescue sled recited in claim 1, wherein said body is manufactured from a closed cell foam so as to float when the rescue sled is deployed in the water.

3. The rescue sled recited in claim 2, wherein the first end of said anchor line that is attached to the body of said rescue sled is rolled up on and dispensed from a fishing reel that is affixed to said body.

4. The rescue sled recited in claim 3, wherein said fishing reel is affixed to said body at the top and spaced rearwardly from said front end thereof.

5. The rescue sled recited in claim 4, further comprising a mounting plate located on the top of said body, said fishing reel being affixed to the top of said body at said mounting plate.

6. The rescue sled recited in claim 1, wherein said steering line pulley by which to couple said anchor line to said steering line is located at the bottom of said body at approximately midway between the front and rear ends thereof.

7. The rescue sled recited in claim 6, said anchor line running from the first end thereof in a first direction along the top of said body to the front end of said body, whereupon said anchor line bends around said front end and then runs in an opposite direction along the bottom of said body.

8. The rescue sled recited in claim 7, wherein said anchor line includes an anchor line pulley, said anchor line that runs in said opposite direction along the bottom of said body bending around said anchor line pulley, and said anchor line then running in said first direction along the bottom of said body to the opposite free end of said anchor line that extends outwardly from said body.

9. The rescue sled recited in claim 8, wherein said steering line pulley is coupled to said anchor line pulley, said steering line pulley lying on and riding over said stationary steering line towards one of the opposite sides of said body in response to the operator shifting his weight towards the one of said sides.

10. The rescue sled recited in claim 7, further comprising a line guide attached to the front end of said body and having line containment walls standing upwardly from first and opposite sides thereof, said anchor line also running over said line guide and between said line containment walls thereof when said line portion bends around the front end of said body.

11. The rescue sled recited in claim 10, further comprising a bumper attached to the front end of said body to repel debris floating in the water and encountered by said rescue sled during the rescue, said bumper lying over said line guide, such that said anchor line bends around the front end of said body and runs between said bumper and said line guide.

12. The rescue sled recited in claim 11, wherein said bumper is detachably connected to said line guide.

13. A rescue sled to be deployed in water and maneuvered by an operator to rescue an individual floating in the water, said rescue sled including a body having a top, a bottom and opposite ends, and comprising:

an anchor line having a first end attached to the top of said body, said anchor line running along the top and then along the bottom of said body, said anchor line also having an opposite free end extending outwardly from the bottom of said body and adapted to be tied to an anchor located outside the water in which the rescue sled is deployed;

a stationary steering line extending laterally across the bottom of said body between the opposite sides of said body, located between the front end and rear end thereof; and an anchor line pulley and a steering line pulley coupled to one another below the bottom of said body, said anchor line bending around said anchor line pulley, and said steering line pulley lying on said stationary steering line and riding over said steering line towards one of the opposite sides of said body in response to the operator shifting his weight towards the one of said sides so that the rescue sled is steered towards the individual in need of being rescued.

14. A method for operating a rescue sled in water to enable an operator of the rescue sled to rescue an individual floating in the water, wherein said rescue sled includes a body having a front end, a rear end, a top, a bottom and opposite sides, said method comprising the steps of:

attaching a first end of an anchor line to the top of said body;

attaching a stationary steering line laterally across the bottom of said body between the opposite sides located between the front end and the rear end thereof;

running said anchor line along the top of said body towards said front, and then coupling the anchor line to the steering line below said body;

deploying the rescue sled in the water in which the individual to be rescued is floating;

tying the opposite end of said anchor line to an anchor located outside the water in which the rescue sled is deployed; and steering the rescue sled towards the floating individual by the operator shifting his weight towards one of the opposite sides of the body for causing the anchor line to correspondingly move relative to said stationary steering line towards the one of said sides.

15. The method recited in claim 14, comprising the additional step of dispensing the said anchor line from a supply thereof until the speed of the rescue sled matches the speed of the individual floating in the water.

16. The method recited in claim 15, comprising the additional step of winding the supply of anchor line around and dispensing the supply of anchor line from a fishing reel located on the top of said body.

17. The method recited in claim 14, comprising the additional steps of coupling the anchor line to the stationary steering line by bending said anchor line around an anchor line pulley, laying a steering line pulley on said stationary steering line so that the steering line pulley rides over said steering line in response to the operator of said rescue sled shifting his weight towards one of the opposite sides of said body, and coupling said anchor line pulley and said steering line pulley to one another at the bottom of said body.

18. The method recited in claim 17, comprising the additional step of coupling said anchor line pulley and said steering line pulley to one another at approximately midway between the front and rear ends of said body.

* * * * *